US009017602B2

(12) United States Patent
Decker et al.

(10) Patent No.: US 9,017,602 B2
(45) Date of Patent: Apr. 28, 2015

(54) METHOD AND APPARATUS OF FORMING A WROUGHT MATERIAL HAVING A REFINED GRAIN STRUCTURE

(75) Inventors: Raymond F. Decker, Ann Arbor, MI (US); Jack Huang, Ann Arbor, MI (US); Sanjay G. Kulkarni, Livonia, MI (US); Stephen E. Lebeau, Northville, MI (US); Ralph E. Vining, Brooklyn, MI (US)

(73) Assignee: Thixomat, Inc., Livonia, MI (US)

( * ) Notice: Subject to any disclaimer, the term of this patent is extended or adjusted under 35 U.S.C. 154(b) by 293 days.

(21) Appl. No.: 13/577,313

(22) PCT Filed: Feb. 4, 2011

(86) PCT No.: PCT/US2011/023746

§ 371 (c)(1), (2), (4) Date: Aug. 6, 2012

(87) PCT Pub. No.: WO2011/097479

PCT Pub. Date: Aug. 11, 2011

(65) Prior Publication Data

US 2012/0305145 A1 Dec. 6, 2012

Related U.S. Application Data

(60) Provisional application No. 61/301,840, filed on Feb. 5, 2010.

(51) Int. Cl.

| | |
|---|---|
| ***B22F 3/20*** | (2006.01) |
| ***B22D 17/00*** | (2006.01) |
| ***C22F 1/00*** | (2006.01) |
| ***C22F 1/04*** | (2006.01) |

(Continued)

(52) U.S. Cl.

CPC ..... *B22D 17/007* (2013.01); *C22F 1/04* (2013.01); *C22F 1/06* (2013.01); *C22F 1/08* (2013.01); *C22F 1/12* (2013.01); *C22F 1/165* (2013.01)

(58) Field of Classification Search

CPC ..... B22F 3/22; B22F 3/225

USPC ..... 148/522, 523, 538–557; 419/61–69; 75/228–250; 164/47, 459–491, 48, 164/492–501, 53, 54, 55.1, 56.1, 57.1, 58.1, 164/59.1, 61–63, 65, 66.1, 67.1, 68.1, 69.1, 164/70.1, 71.1, 72, 74, 75, 76.1, 77–91, 164/92.1, 93–122, 122.1, 122.2, 123–138, 164/900

See application file for complete search history.

(56) References Cited

U.S. PATENT DOCUMENTS

| | | | | |
|---|---|---|---|---|
| 4,935,072 | A * | 6/1990 | Nguyen-Dinh | 148/562 |
| 2003/0037848 | A1 | 2/2003 | Hashimoto et al. | |

(Continued)

FOREIGN PATENT DOCUMENTS

| | | |
|---|---|---|
| EP | 0 745 694 | 12/1996 |
| JP | 56-62670 | 5/1981 |

(Continued)

OTHER PUBLICATIONS

International Search Report of PCT/US2011/023746 Mailed on Jul. 27, 2011 (6 pages).

*Primary Examiner* — Scott Kastler

*Assistant Examiner* — Vanessa Luk

(74) *Attorney, Agent, or Firm* — Brinks Gilson & Lione

(57) ABSTRACT

A method of forming a wrought material having a refined grain structure is provided. The method comprises providing a metal alloy material having a depressed solidus temperature and a low temperature eutectic phase transformation. The metal alloy material is molded and rapidly solidified to form a fine grain precursor that has fine grains surrounded by a eutectic phase with fine dendritic arm spacing. The fine grain precursor is plastic deformed at a high strain rate to cause recrystallization without substantial shear banding to form a fine grain structural wrought form. The wrought form is then thermally treated to precipitate the eutectic phase into nanometer sized dispersoids within the fine grains and grain boundaries and to define a thermally treated fine grain structure wrought form having grains finer than the fine grains and the fine dendritic arm spacing of the fine grain precursor.

37 Claims, 9 Drawing Sheets

(51) Int. Cl.

| | |
|---|---|
| ***C22F 1/06*** | (2006.01) |
| ***C22F 1/08*** | (2006.01) |
| ***C22F 1/12*** | (2006.01) |
| ***C22F 1/16*** | (2006.01) |

(56) References Cited

U.S. PATENT DOCUMENTS

| | | | | |
|---|---|---|---|---|
| 2003/0230392 | A1 | 12/2003 | Czerwinski et al. | |
| 2008/0000557 | A1 | 1/2008 | Ghosh et al. | |
| 2009/0087681 | A1 | 4/2009 | Decker et al. | |
| 2009/0136379 | A1 | 5/2009 | Torng et al. | |
| 2009/0185944 | A1* | 7/2009 | Hu | 420/448 |

FOREIGN PATENT DOCUMENTS

| | | |
|---|---|---|
| JP | 7-204820 | 8/1995 |
| JP | 3416503 | 6/2003 |

* cited by examiner

METHOD AND APPARATUS OF FORMING A WROUGHT MATERIAL HAVING A REFINED GRAIN STRUCTURE

CROSS REFERENCE TO RELATED APPLICATIONS

This application is a §371 national stage application of International Application No. PCT/US2011/023746 filed on Feb. 4, 2011, which claims priority to U.S. Provisional Application No. 61/301,840 filed on Feb. 5, 2010, the entire contents of which are hereby incorporated by reference.

STATEMENT OF GOVERNMENTAL SUPPORT

This invention was made with Government support under NSF STTR Project No. 0847198 awarded by the National Science Foundation. The U.S. Government has certain rights to this invention.

BACKGROUND

1. Field of the Invention

The present invention relates to producing a wrought material with one or more enhanced mechanical properties. More particularly, the invention relates to producing a metal alloy wrought material, having micrometer sized grain structures for enhancing one or more mechanical properties such as strength and/or elongation.

2. Related Technology

Many metals, such as for example, Magnesium (Mg) and Aluminum (Al), represent light commercial metals for various structural applications, Mg being the lighter of the two. However, high impact resistant and formability applications require materials with sufficient strength and ductility to absorb the energy generated during an impact or forming process. This requirement limits the use of conventional Mg and Al alloys for such applications. For example, conventional Mg alloys have low yield strengths of about 130-180 MPa, have poor formability and have poor crack tolerance. These properties make conventional Mg alloys unsuitable for many applications because the alloy is more likely to crack after only moderate deformation.

The alloying elements that improve corrosion resistance and castability of various metals, such as Al additions to the Mg base, unfortunately introduce eutectic intermetallic phases, which envelope the primary grains in a coarse and brittle morphology in the commercial alloys. Furthermore, it is difficult to attain efficient age hardening by fine precipitates within the grains, as exemplified by the case of inefficient Al additions to Mg. Elements that promote age hardening in Mg, such as rare earth metals, are costly, detrimental to castability and ineffective in resisting corrosion. As a consequence of these barriers, increases in strength have been marginal, at best, and decade-old metal alloys, such as Magnesium based AZ31 and AZ91D, still dominate the tonnage of commercial sheet and casting markets, even though AZ31 lacks strength and AZ91D lacks ductility for many sheet markets.

Accordingly, there is a need for an apparatus and process that can be carried out in a rapid and automated manner so as to change alloy composition and grain structure, thereby allowing such processed alloys to be subsequently worked into impact resistant and/or formable wrought forms with sufficiently high strength and ductility.

SUMMARY OF THE INVENTION

In achieving the above object, the inventors have discovered a practical new process and apparatus to generate inexpensive fine grain or ultra fine grain dispersion hardened wrought material forms comprising various metal alloys, where grain sizes of less than or equal to about 3 μm are achieved, which can provide impact resistance and/or formability with sufficiently high strength and ductility for various applications.

The present process involves the deformation strain processing of fine grain structures initially formed from various rapid solidification molding methods that can produce a fine grain precursor, including injection molding and variations on injection molding, die casting and extrusion molding. Thereafter, the wrought form is accomplished by a combination of high strain rate deformation, such as rolling, superplastic forming, drawing or stamping, etc., and various thermal treatments. Thus, the present invention provides for the initial formation of a fine grain precursor, a precursor having a grain size of less than about 10 μm. Thereafter, the fine grain precursor is subjected to deformation straining and thermal treatments to break down the microstructure of the precursor, including the intermetallic eutectic phases, and produce new grain boundaries with nanometer sized dispersoids of eutectic phase. The resulting wrought form has a grain structure of less than about 3 μm, lending itself to subsequent shaping by superplastic forming or other processes.

Accordingly, in at least one embodiment of the present invention a method of forming a wrought material having a refined grain structure is provided. The method comprises providing a metal alloy material having a depressed solidus temperature and a low temperature eutectic phase transformation. The metal alloy material is substantially melted, molded at a high shot velocity and short fill time so as to be rapidly solidified to form a low porosity, fine grain precursor having fine grains surrounded by eutectic phase with fine dendritic arm spacing. The fine grain precursor is plastically deformed by a high strain rate deformation strain to reduce or weld the porosity and cause recrystallization without substantial shear banding, thereby forming a fine grain structural wrought form preferably having an ultra fine grain structure. Imparting plastic deformation to the fine grain precursor includes at least one of subdividing or dissolving the eutectic phase, and a portion of the eutectic phase is precipitated during TMP. The fine grain structural wrought form is thermally treated to further disperse the eutectic phase and to define a thermally treated fine grain structure wrought form having grains and dendritic arm spacing that is finer than the fine grains and the fine dendritic arm spacing of the fine grain precursor. The precipitated eutectic phase forms nanometer sized dispersoids within the fine grains and/or grain boundaries of the thermally treated fine grain structure wrought form.

In one aspect, the fine grain precursor has a porosity of less than about percent 1.5%.

In another aspect, the imparting of one or more thermal treatments includes a first thermal treatment of exposing the fine grain structural wrought form to a temperature of between about 225° C. and 325° C.

In yet another aspect, the imparting of one or more thermal treatments includes a second and subsequent thermal treatment of exposing the fine grain structural wrought form to a temperature of between about 125° C. and 215° C. after the first thermal treatment.

In a further aspect, the fine grain structural wrought form is one of flattened, stretched, deep drawn and superplastically formed during imparting of one or more thermal treatments.

In another aspect, the metal alloy material is a magnesium based alloy with alloying constituents comprising aluminum, zinc, manganese, calcium, strontium, samarium, cerium, rare earths, tin, zirconium, yttrium, lithium, antimony or a mixture thereof.

In another aspect, the metal alloy material has a Mg—Al—Zn base alloy (containing between 4.5% and 8.5% Al) for structural applications, a Mg—Zn—Y base or a Mg—Zn—Ca base or a Mg—Zn—Ca—Mn base alloy for biomedical applications.

In yet another aspect, the metal alloy material is an aluminum based alloy with alloying constituents comprising copper, magnesium, lithium, silicon, zinc_or a mixture thereof.

In another aspect, the metal alloy material is a copper based alloy with alloying constituents comprising magnesium, phosphorus, zinc, antimony, tin, silicon, titanium, or a mixture thereof.

In still yet another aspect, the metal alloy material is a zinc based alloy with alloying constituents comprising aluminum, copper, or a mixture thereof.

In a further aspect the metal alloying material is a lead based alloy with alloying constituents comprising antimony, tin, or a mixture thereof.

In one aspect, the fine grain structural wrought form has ultra fine grains.

In another aspect, a matrix phase is defined including grain boundaries, and the intermetallic eutectic phase pins the grain boundaries of the matrix phase.

In still another aspect, molding of the metal alloy material includes one of all-liquid metal injection molding and semi-solid metal injection molding In another aspect, the metal alloy material is injection molded at a shot velocity of more than about 3 m/sec. and a fill time "t" of less than 0.04 sec.

In one aspect, injection molding of the metal alloy material further includes applying a vacuum to the metal alloy material.

In another aspect, injection molding of the metal alloy material further includes providing argon gas to the metal alloy material.

In yet another aspect, injection molding of the metal alloy further includes flood feed and hopper heating.

In still another aspect, molding of the metal alloy includes die casting of the metal alloy material.

In one other aspect, molding of the metal alloy includes continuous casting of the metal alloy material.

In still another aspect, imparting plastic deformation to the fine grain precursor includes rolling the fine grain precursor by a high strain rate deformation strain to form the fine grain structural wrought form.

In a further aspect, imparting plastic deformation to the fine grain precursor includes extruding the fine grain precursor by a high strain rate deformation strain to form the fine grain structural wrought form.

In another aspect, imparting plastic deformation to the fine grain precursor includes forging the fine grain precursor by the high strain rate deformation strain to form the fine grain structural wrought form.

In still another aspect, imparting plastic deformation to the fine grain precursor includes one of flow forming and spinning the fine grain precursor by a high strain rate deformation strain to form the fine grain structural wrought form.

In one aspect, imparting plastic deformation to the fine grain precursor includes pressing the fine grain precursor by a high strain rate deformation strain to form the ultra fine grain structural wrought form.

In another aspect, molding and rapidly solidifying the metal alloy material includes cooling the metal alloy material in a mold at a cooling rate of more than about 50 degrees Celsius per second to form the fine grain precursor.

In still another aspect, the high strain rate deformation strain ($\dot{\epsilon}$) produces a Zener factor (Z) of greater than about $10^9$ $s^{-1}$ as determined by the formula $Z=\{\dot{\epsilon}\cdot\exp(Q/RT)\}^{-0.2}$, where Q is the activation energy (135 kj $mol^{-1}$), T is the temperature, and R is the gas constant.

In yet another aspect, the fine grains of the fine grain precursor have sizes less than about 10 μm.

In another aspect, the eutectic phase of the fine grain precursor is between about 3 and 15 percent by volume of the metal alloy material.

In another aspect, the thermally treated fine grain structural wrought form has ultra fine grains with sizes of less than about 3 μm, and eutectic phase particulates with sizes of less than about 1 μm forming the nanometer-sized dispersion of the eutectic phase.

In still another aspect, a plurality of the fine grain precursors or a plurality of the fine grain structure wrought forms are stacked to form a stack, and layers of the stack are bonded together by hot isostatic pressing the stack.

In another aspect, reinforcing elements are disposed between the layers of the stack and bonding of the layers includes bonding the reinforcing elements to the layers by hot isostatic pressing the stack.

In yet another aspect, the method further comprises forming a laminate composite structure by bonding the fine grain structural wrought form to a polymer matrix composite that contains fibers comprising carbon fibers, polymer fibers, glass fibers or a mixture thereof.

In at least another embodiment of the present invention, a system for forming a wrought material having a refined grain structure is provided. The system comprises molding, injecting at high velocity and short fill time and rapidly solidifying means including a mold that forms a fine grain precursor from a substantially melted metal alloy material. The metal alloy material has a depressed solidus temperature and a low temperature eutectic phase transformation. The fine grain precursor has low porosity and fine grains surrounded by a coarse eutectic phase with fine dendritic arm spacing. The system further comprises a plastic deformation means including at least one forming member that imparts a high strain rate deformation strain to the fine grain precursor to reduce the porosity and cause recrystallization, without substantial shear banding, thereby forming a fine grain structural wrought form. The high strain rate deformation strain at least subdivides and/or dissolves the eutectic phase and precipitates a portion of the eutectic phase of the fine grain precursor. The system also comprises thermal treatment means including at least one heating member that imparts at least one thermal treatment to the fine grain structural wrought form to further disperse the eutectic phase and to define a thermally treated fine grain structure wrought form having grains and dendritic arm spacing that is finer than the fine grains and the fine dendritic arm spacing of the fine grain precursor. The precipitated eutectic phase forms nanometer sized dispersoids within the fine grains and/or grain boundaries of the thermally treated fine grain structure wrought form.

In at least one other embodiment of the present invention, a wrought material having a refined grain structure is provided. The wrought material comprises a thermally treated fine grain structure wrought form formed of a metal alloy having a depressed solidus temperature and a low temperature eutectic phase transformation. The thermally treated fine grain structure wrought form has ultra fine grains and grain boundaries with nanometer sized dispersoids of precipitated eutectic phase within the ultra fine grains and the grain boundaries.

DETAILED DESCRIPTION OF THE PREFERRED EMBODIMENTS

Figure 1:
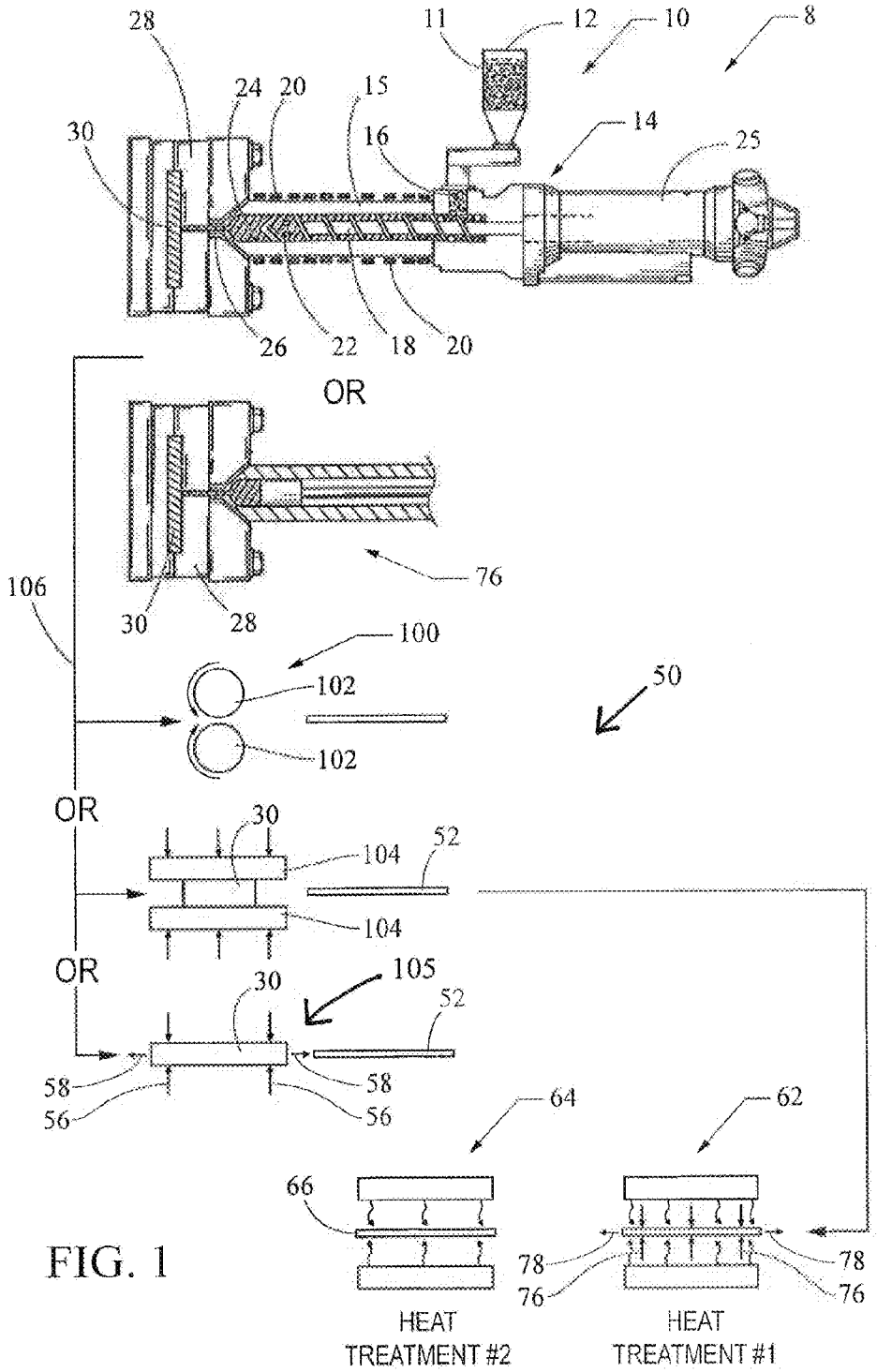
FIG. 1 is a schematic illustration of one embodiment of a manufacturing cell and method embodying the principles of the present invention.

Various embodiments of the present invention are disclosed herein. It should be understood, however, that the disclosed embodiments are merely exemplary of the invention, which may be embodied in various and other alternative forms. The figures are not necessarily to scale; some figures may be configured to show the details of a particular component. Therefore, specific structural and functional details disclosed herein are not to be interpreted as limiting, but merely as a representative basis for the claims and for teaching one skilled in the art to practice the present invention.

With the present invention, new processes have been created that increase the strength, ductility and formability of certain metal alloys, such as Mg alloys or other suitable metal alloys. The key is a low cost bulk process to generate, for example, novel nanostructured metal alloys, such as Mg alloys with low texture, accomplished by Thixomat's fine-grained injection molding process, known as Thixomolded® or Thixomolding®, followed by vigorous thermomechanical processing (e.g. high strain rate deformation) by roll passes, compressing, flattening, etc. (the fine grain injection molding process followed by vigorous thermomechanical processing being herein referred to as "TTMP") and one or more thermal treatments. Alloy design has devised novel compositions that are tuned to take advantage of the new process. Also, stacked sheet bars have been bonded and heavy rolling reductions have been accomplished in one pass, opening the way for the production of a large area, wrought sheet form stock. Furthermore, experiments have demonstrated the feasibility of incorporating reinforcements into the nanostructured metal alloy matrix.

According to the principles of the present invention, a fine grain precursor is formed by the injection molding (IM) of metal, such as by a semi-solid or all liquid metal injection molding technique, for example by the Thixomolding Process® performed by Thixomat, Inc. (Ann Arbor, Mich.), as is further discussed below. With use of this process, melt temperatures can be lowered to near liquidus, some 80 to 100° C. lower than in direct cast (DC) or twin roll casting (TRC). These lower temperatures are believed to assist in faster cooling to nucleate finer grains upon solidification. As injection molded, the metal alloys (e.g. Mg alloys) are isotropic, that is they have a homogeneous microstructure, with 4 to 7 μm grain size α phase. (As used herein, grain sizes below 10 μm yet above 3 μm, are referred to as fine grain sizes.) Moreover, these injection molded Mg alloys have been found to exhibit non-columnar grains with less gas and shrink porosity when high shot velocities and short fill times are used. Through the use of multiple feeding ports, the rapid injection molding of large forms (e.g. sheet bars) is possible. Moreover, a hot runner system may be employed for delivery of the liquid metal to a mold for solidification, which may improve production yields of the large sheet bars. Suitable sheet bar can be readily molded in existing commercial Thixomolding® machines, of sizes up to 1000 tons, with sheet dimensions of up to about 6×400×400 mm.

Referring to FIG. 1, this figure schematically illustrates an apparatus, generally designated at 8, embodying the principles of the present invention. The apparatus 8 includes a molding machine 10 for the metal injection molding of sheet bar 30. As seen in FIG. 1, the construction of the molding machine 10 is, in some respects, similar to that of a plastic injection molding machine. The machine 10 is fed with feedstock 11 via a hopper 12 (e.g. heated or unheated hopper) or alternatively flood fed, into a heated, reciprocating screw injection system 14, which maintains the feedstock under a protective atmosphere, such as argon.

Figure 2:
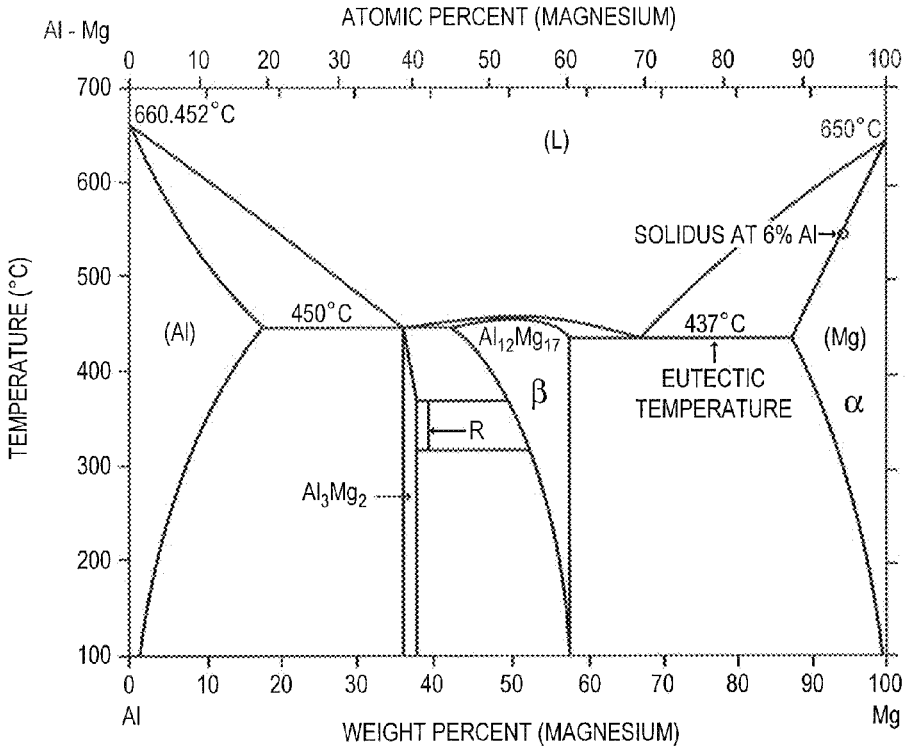
FIG. 2 is a phase diagram for Magnesium-Aluminum alloys, showing solidus for 6% Al and Eutectic.

The feedstock 11 is preferably a metal alloy having a depressed solidus temperature and a low temperature eutectic phase transformation. For example and with reference to FIG. 2, a Magnesium-Aluminum (Mg—Al) phase diagram is provided. As indicated, pure Mg has a solidus temperature of 650° C., while the Mg alloy AZ61L (a Mg alloy having 6% Al and being one of many suitable metal alloys for feedstock 11 in accordance with the present invention) has a depressed solidus temperature and low eutectic phase transformation corresponding to a solidus temperature of 525° C. and a eutectic temperature of 437° C. AZ31 alloy, which contains 3% Al, has a higher solidus temperature of about 605° C. and a eutectic phase below 3% of the volume. When utilized in TTMP, its precursor grain size is coarser than 10 μm and, with subsequent heat treatments; it does not undergo refinement comparable to the higher Al alloys. Other metal alloy materials suitable as feedstock 11 for either the molding machine 10, or an alternative such as a die casting, continuous casting or extrusion apparatus (schematically illustrated and generally designated at 76), are as follows: magnesium based alloys with alloying constituents comprising aluminum, zinc, manganese, calcium, strontium, samarium, cerium, rare earths, tin, zirconium, yttrium, lithium, antimony or a mixture thereof; aluminum based alloys with alloying constituents comprising copper, magnesium, lithium, silicon, zinc, or a mixture thereof; copper based alloys with alloying constituents comprising magnesium, phosphorus, zinc, antimony, tin, silicon, titanium, or a mixture thereof; zinc based alloys with alloying constituents comprising aluminum, copper, or a mixture thereof; lead based alloys with alloying constituents comprising antimony, tin, or a mixture thereof.

As illustrated in FIG. 1, the feedstock 11 is received from the hopper 12 into a barrel 15 via an inlet 16 located at one end of the barrel 15. Within the barrel 15, the feedstock is moved forward by the rotating motion of a screw 18 or other means. As the feedstock is moved forward by the screw 18, it is also heated by heaters 20 (which may be a resistance, induction or other type of heater) while being stirred and sheared by the action of the screw 18. This heating and shearing is done to bring the feedstock material into a substantially melted state such that the feedstock material is injectable. This injectable material passes through a non-return valve 22 and into an accumulation zone 24, located within the barrel 15 beyond the forward end of the screw 18. Upon accumulation of the needed amount of injectable material in the accumulation zone 24, the injection portion of the cycle is initiated by advancing the screw 18 with a hydraulic or other actuator 25. Advancement of the screw 18 causes the material in the accumulation chamber 24 to be ejected through a nozzle 26 into a mold 28 filling the mold cavity defined thereby and forming a precursor work piece such as sheet bar 30. In at least one embodiment, the screw shot velocity is at least 3 meters/second and preferably more than about 3 meters/second. The machine recorded fill times are less than 0.06 seconds and the ideal fill times, t, are less than 0.04 seconds. A hot runner system (not shown) may optionally be used to assist delivery of the material to the mold cavity thereby minimizing any heat loss. Moreover, because this process may result in a "frozen plug", that is the metal solidifies where the mold receives the injectable material, pulling a vacuum on the mold during molding is feasible and may further be used to decrease resulting porosity of the sheet bar 30. This initial formation of the precursor allows the developing of a multiphase microstructure with intermetallic eutectic phases.

In one preferred embodiment, the metallurgical process of the machine 10 results in the processing of the particulate feedstock into a solid plus liquid phase prior to its injection into the mold 28. Various versions of this basic process are known and two such versions are disclosed in U.S. Pat. Nos. 4,694,881 and 4,694,882, which are herein incorporated by reference. The process generally involves the shearing of the semisolid metal so as to inhibit the growth of dendritic solids and to produce non-dendritic solids within a slurry having improved molding characteristics which result, in part, from its thixotropic properties. (A semisolid non-dendritic material exhibits a viscosity that is inversely proportional to the applied shear rate, that is the viscosity increases with decreased shear or vice versa, and which is lower than that of the same alloy when in a dendritic state). Variations on this process of forming the sheet bar 30 may include providing the alloy material initially in a form other than a particulate; heating the alloy material to an all liquid phase and subsequently cooling into the solid plus liquid phase; employing separate vessels for processing of the alloy and injecting of the alloy; utilizing gravity or other mechanisms to advance the alloy through the barrel to the accumulation zone; alternate feeding mechanism, including electromagnetic; and other variations on the process. However, process parameters must be such that the precursor molded thereby has a fine grain structure. Not all variations on the above process will result in a fine grain structure.

In another preferred embodiment, the metallurgical process of the machine 10 results in the processing of the particulate feedstock into an all liquid phase (as opposed to a semi-solid phase) that is injected into the mold 28 and rapidly solidified.

In another embodiment, the liquid phase material in the mold is rapidly solidified at a cooling rate of more than about 50° C./second and preferably at least about 80° C./second.

In another embodiment, the metallurgical process of the machine 10 results in the sheet bar 30 having a total porosity that is preferably less than about 1.5%. The total porosity includes both shrinkage porosity and gas porosity. Shrinkage porosity, which is derived from shrinkage of the metal alloy, comprises voids that are more linear or flattened shaped and formed in the eutectic regions around the grain boundaries, whereas gas porosity comprises voids that are more spherically shaped. The previously mentioned fill time and shot velocity have unexpectedly been found to be critical to achieving this low total porosity.

In another preferred embodiment, a protective argon atmosphere with a moisture content of less than about 0.1 percent is provided for the feedstock in the apparatus 8 to minimize gas porosity of the resulting sheet bar 30 so as not to exceed 1 percent gas porosity in the sheet bar 30 with minimal formation of oxides.

Figure 4A:
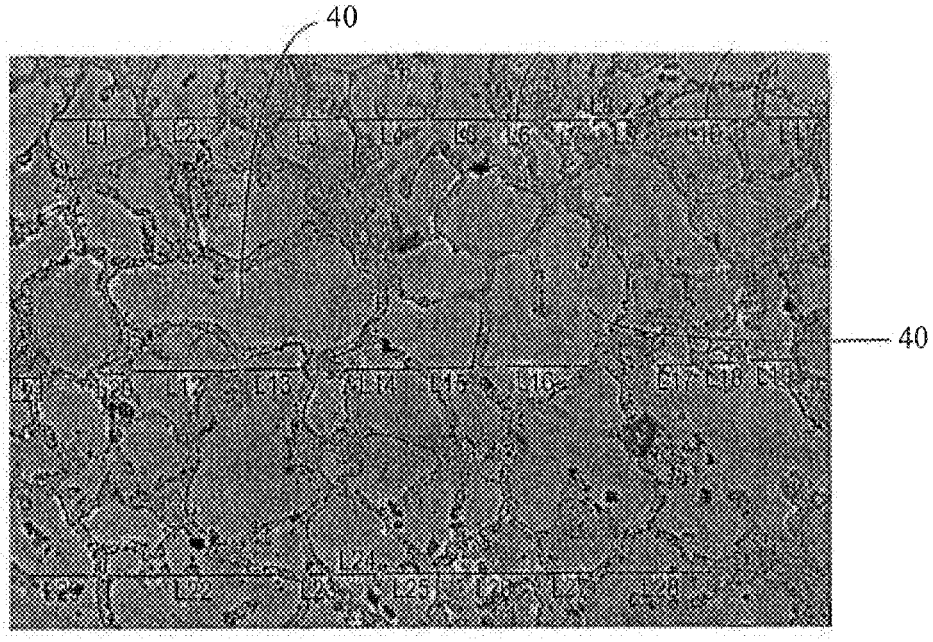
FIG. 4A is an electron micrograph of the grain microstructure of cast AZ31 and show the presence of large grain sizes and a low volume of eutectic phase.

In accordance with the present invention, the resultant sheet bar 30 has a fine grain microstructure with grain sizes of less than about 10 μm and which are surrounded by a eutectic phase. The eutectic phase comprises between about 3% and 15% of the volume of the sheet bar 30. For example, FIG. 4A is a micrograph, at 500× magnification, of die cast AZ31 metal alloy, magnesium alloy having approximately 3% Al with a solidus temperature of about 605° C. The grains in this figure are numerically designated at 40 and there is very little eutectic phase (less than 3% by volume), contrary to that which is seen with AZ61L which presented in FIG. 4B.

Referring back to FIG. 1, once the fine grained sheet bar 30 is formed, it is plastically deformed at a relatively high deformation strain rate using one or more thermal mechanical processes (TMP) 50 to form a fine grain structural wrought sheet 52. The deformation strain decreases the porosity of the sheet bar 30 by welding at least a portion of the porosity with the surrounding metal alloy. Preferably, deformation straining of the sheet bar 30 permits storage of dislocations within the microstructure, which leads to the formation of new grain boundaries with high misorientation suitable for subsequent warm forming or superplastic forming.

In one implementation of the TMP process 50, the sheet bar 30, which may be heated or at room temperature, is plastically deformed at a relatively high strain rate to cause recrystallization of the fine grain structure to an ultra fine grain structure (i.e. grain sizes of less than or equal to about 2 μm, see par. [0059]). This recrystallization may include a continuous dynamic recrystallization mechanism producing at least fifty percent (50%) high angle grain boundaries and an intensity of basal (0002) texture not exceeding about 5. Moreover, the strain rate ($\dot{\epsilon}$) and the temperature (T) preferably produce a Zener factor (Z) of greater than about $10^9$ $s^{-1}$ as determined by the formula $Z=\{\dot{\epsilon}\times\exp(Q/RT)\}^{-0.2}$, where Q is the activation energy (135 kj $mol^{-1}$), and R is the gas constant.

In at least one embodiment, the deformation strain rate is in the range of approximately 0.1 to 50 $s^{-1}$. While deformation straining may be done at room temperature, when heated, it is preferred that the temperature of the sheet bar 30 during deformation straining is in the range of approximately 250° C. to 450° C., depending on the specific alloy composition. Further, the deformation strain is preferably at least 0.5. In one example, the deformation strain further plastically deforms the sheet bar by predominately a slip mechanism of the grain microstructure with less than 10% twinning and substantially no shear banding.

In the TMP process, the high strain rate plastic deformation breaks up (e.g. subdivides) and/or dissolves the eutectic phase 42 where at least a portion of the eutectic phase is precipitated into nanometer sized dispersoids within fine grains and/or ultra fine grains and grain boundaries of the fine grain wrought sheet 52.

Various schemes are envisioned for deforming the sheet bar 30. The sheet bar 30 may be passed through a rolling mill 100 having at least one set of matching rollers 102 or a series of matching rollers (not shown). Alternatively, the sheet bar may be initially compressed or pressed in a press 103 by opposing pressing dies 104 (e.g. superplastic pressing). The matching rollers 102 or the pressing dies 104 may be heated. After being rolled, the rolled sheet bar 30 may be flattened by being compressed or pressed in a press by a heated pair of opposing dies, similar to those mentioned above. Any other suitable arrangement known to those skilled in the art may also be used to plastically deform the sheet bar 30 that provides at least one of a compressive and/or bending force 56, and/or a tensile and/or stretching force 58, such as for example, an extrusion or forging process as is schematically illustrated and numerically indicated at 105. Also, the deformation process may be performed separately from the formation of the sheet bar 30 or may be integrated directly into the processing cell whereby the apparatus 8 is provided with a transfer mechanism (which may be any known variety and which is represented by line 106) to transfer the sheet bar 30 from the mold 28 to the TMP process 50.

Figure 5:
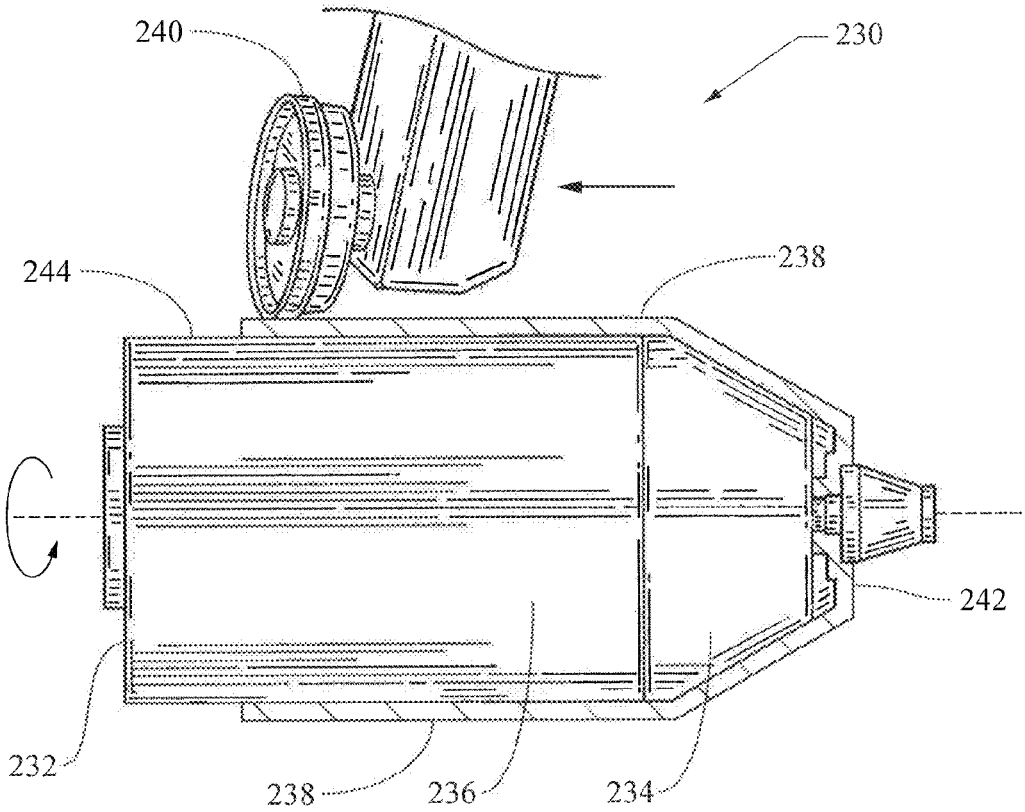
FIG. 5 is a side view of flow forming tool arrangement as might be utilized in accordance with an embodiment of the present invention.
Figure 6:
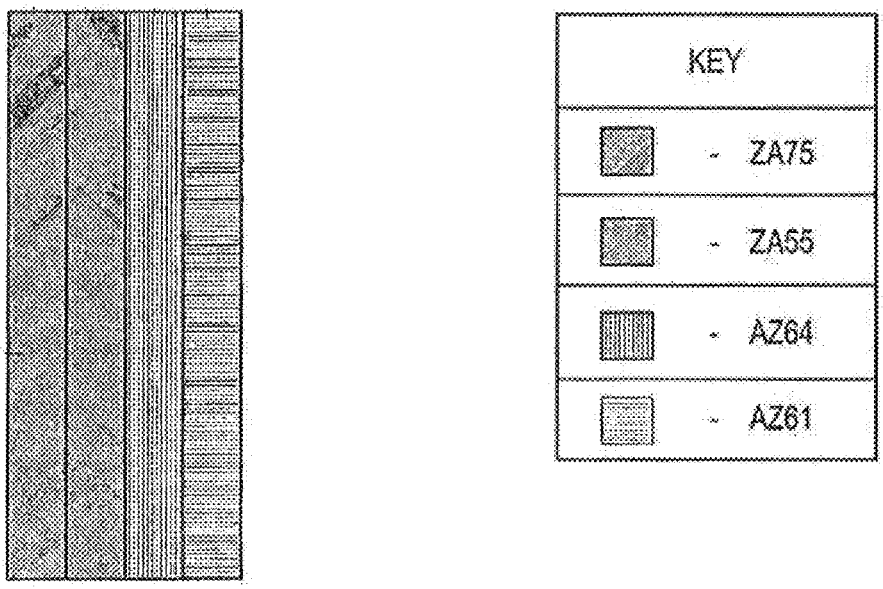
FIG. 6 is a cross-sectional view of a plate stack illustrative of another embodiment of the present invention.
Figure 7:
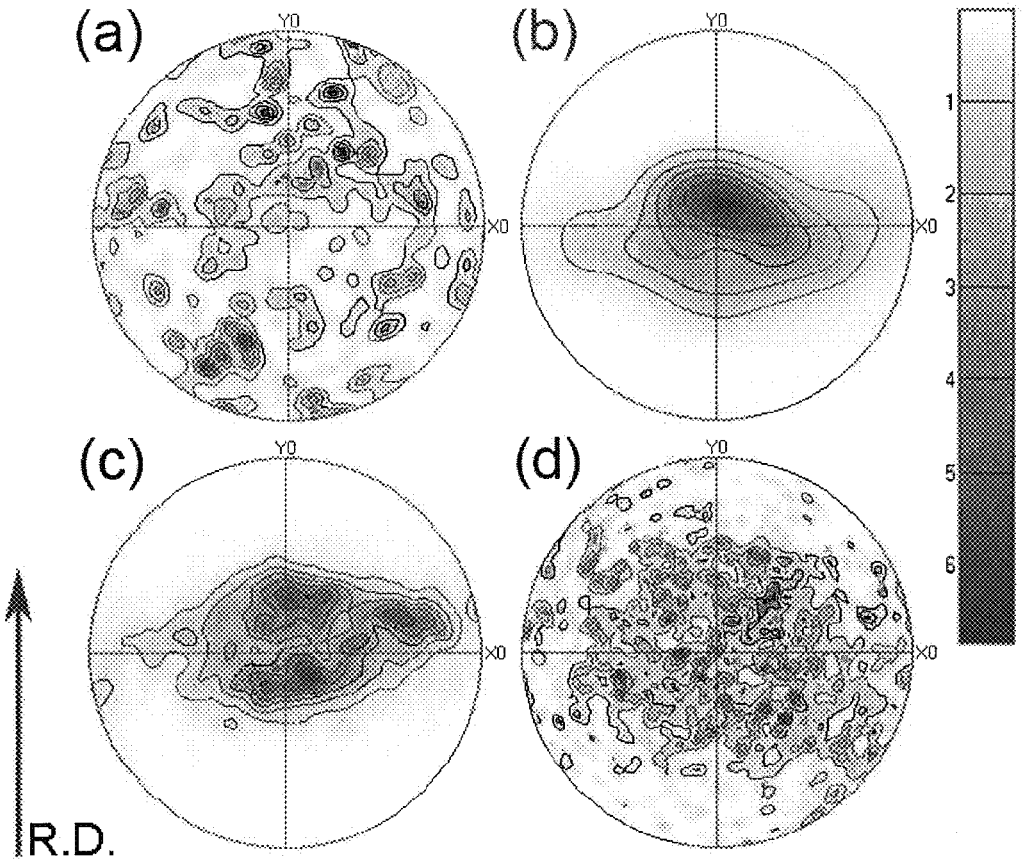
FIG. 7 shows 0001 pole figures of AZ61L a.) as-Thixomolded of random texture, b.) as −TTMP with texture, c.) TTMP+thermal treatment of 3 minutes at 250° C. with diminished texture and d.) TTMP+thermal treatment of 20 minutes at 300° C. with greatly diminished texture. The diminished texture enhances the formability of the alloy.
Figure 8:
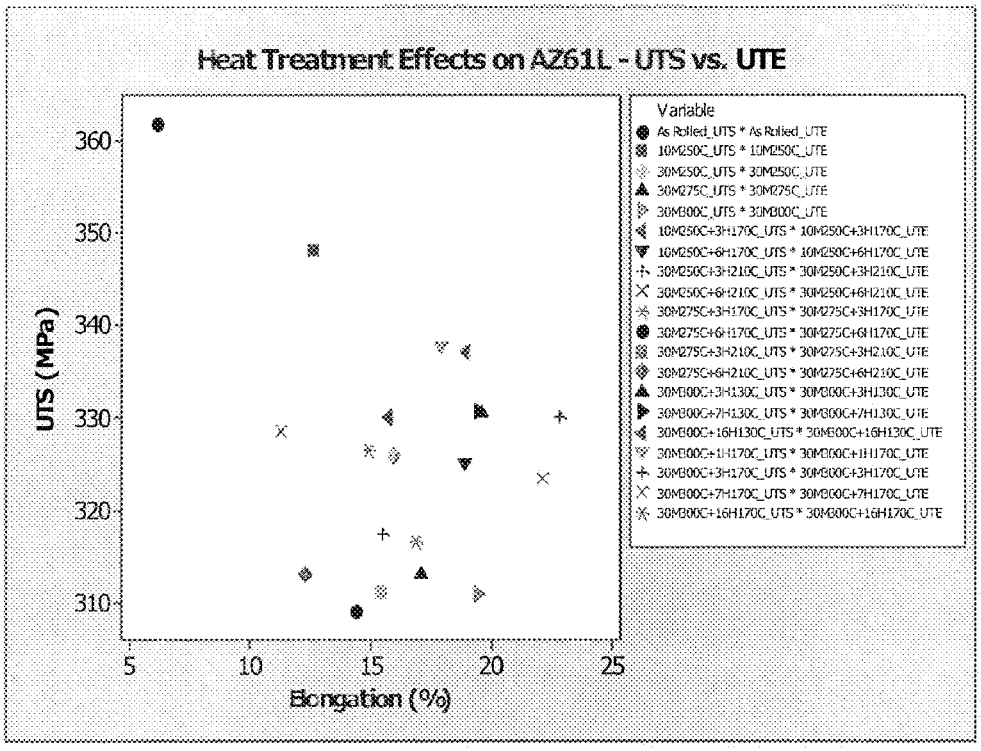
FIG. 8 is a graph showing the effect of first and second thermal treatments on TTMP AZ61L, as to the effect on strength vs. elongation. (Samples were also press flattened for 3 minutes at 275° C., after rolling and before the $1^{st}$ and $2^{nd}$ heat treatments.)

Referring to FIG. 5, as an alternative to the above methods, the TMP process 50 may use a flow forming arrangement 230 for plastically deforming the sheet bar 30. The flow forming arrangement 230 may comprise a mandrel 232 defining a first shape 234 and/or a second shape 236. The sheet bar 30 may be plastically deformed against the mandrel 232 by being spin formed and impressed thereon by a roll 240, which travels from a first end 242 to a second end 244 of the mandrel 232, to form a fine or ultra fine grained shaped piece 238. Such a technique, generally referred to as flow forming, may be used to produce, for example, cylindrical shape.

Referring back to FIG. 1, in accordance with the present invention, the fine grain wrought sheet 52 is further processed via one or more thermal treatments 62 and 64 to define a thermally treated fine grain wrought sheet 66. The fine grain wrought sheet 52 may be individually, batched or continuously thermally treated by any suitable means known to those skilled in the art including via conduction, convention, electric, induction and/or infrared heaters.

In one embodiment, after the fine grain wrought sheet 52 was rolled by opposed rollers 102, the sheet 52 was compressed and flattened between a pair of dies for about 3 minutes at about 275° C., and then exposed to a first thermal treatment 62 having a temperature of between about 225° C. and 325° C. The fine grain wrought sheet 52 may be additionally exposed to a second thermal treatment 64, after the first thermal treatment 62, with the second thermal treatment having a temperature of between about 125° C. and 215° C. The terms "about" and "approximate" contained herein are intended to mean within the corresponding manufacturing, equipment, product or production process tolerances.

As a result of the above, the thermally treated wrought sheet 66 has ultra fine grains with grain sizes of less than about 2 μm. Moreover, the thermal treatments 62 and 64 further precipitate the eutectic phase, forming nanometer sized dispersoids within the fine grains and/or grain boundaries of the treated wrought 66. The sizes of the eutectic phase particulates forming the nanometer sized dispersoids are preferably less than about 1 μm.

Figure 4B:
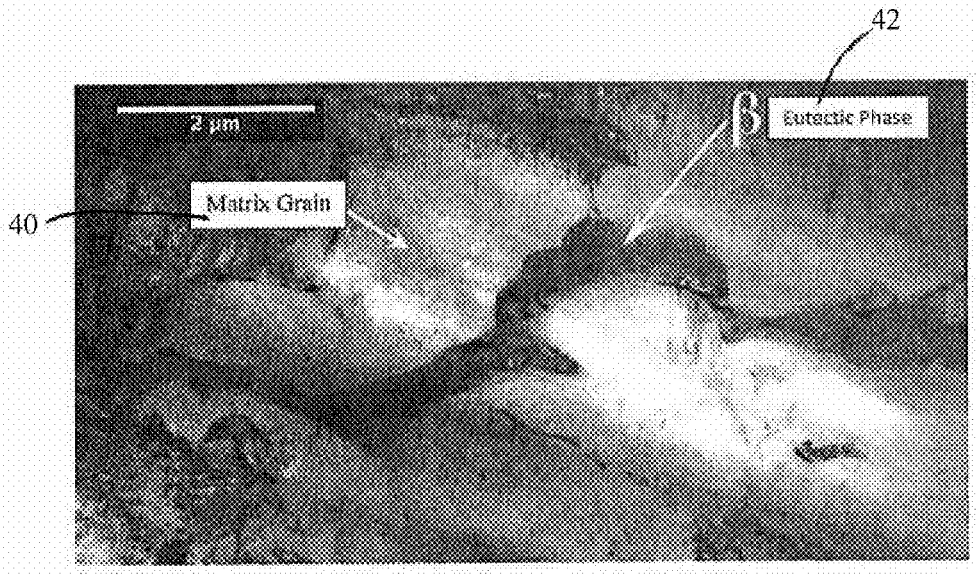
FIG. 4B is an electron micrograph of the grain microstructure of AZ61L in the fine grain injection molded condition, with large elongated β eutectic phase.
Figure 4C:
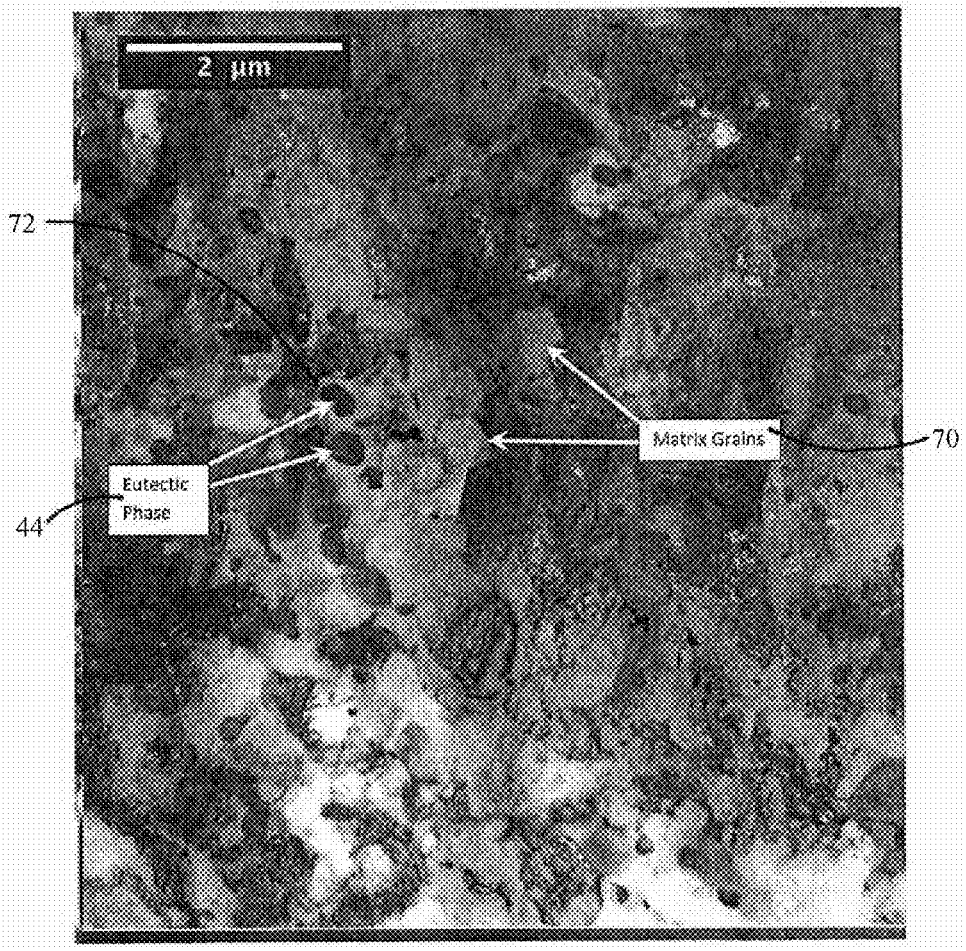
FIG. 4C is an electron micrograph of the grain microstructure of a AZ61L in accordance with an embodiment of the present invention, after TTMP and after a first thermal treatment of 10 minutes at 250° C., which shows a 0.7 μm grain size and nanostructured β phase (dark particles)

FIGS. 4B and 4C illustrate an example of the affects of TMP and thermal treatments on the grain microstructure of metal alloy sheet bar 30 in accordance with the present invention. FIG. 4B is an electron micrograph of AZ61L metal alloy sheet bar 30, without further treatment, which is seen as having fine grains 40 surrounded by eutectic phase 44. FIG. 4C is an electron micrograph of the AZ61L metal alloy after TMP, flattening (as mentioned above) and subsequent first thermal treatment at 250° C. for 10 minutes. Notably, the grain sizes 70 shown in FIG. 4C are finer than the grain sizes 40 shown in FIG. 4B. Also, the eutectic phase in FIG. 4C forms nanometer sized dispersoids 72, unlike the eutectic phase 44 shown in FIG. 4B, which is relatively elongated and coarse.

The thermal treated wrought sheet 66 has enhanced mechanical and/or physical properties, such as for example, improved tensile strength, ductility, fatigue strength, formability, creep resistant strength and/or any combination thereof.

As an additional embodiment, forming forces 78 (see FIG. 1) may be applied to the fine grain wrought sheet 52 during one or more of the thermal treatments 62 and 64. For example, the fine grain wrought sheet 52 may be flattened, stretched, deep drawn and/or superplastically compressed or formed while being thermally treated at 62 and 64. Other suitable forming methods known to those skilled in the art may also be employed while thermally treating the fine grain wrought sheet 52.

Table I (below) compares the properties of various metal alloys that were produced by various methods, which included twin roll casting with TMP processing, commercial direct casting/extruding and TMP processing, and injection molded (IM) and TMP processing. The metal alloys compared are AZ31 (Mg-3Al), AZ6/1.5 (Mg-6Al-1.5Zn), and AZ61L (Mg-6Al). As indicated by the results in the table, the commercial twin roll cast and direct cast AZ31 metal alloy form larger grain sizes than the injection molded (Thixomolded®) stock. The twin roll cast material exhibited the largest grains and also exhibited 45° arrays of fine grains interspersed (shear banding) that lead to severe hot cracking. As seen in Table 1, the injection molded fine grain sheet bar 30 was strengthened more by the TMP processing than the coarser grained commercial stock was by the TMP processing. The lack of response of the AZ31 alloy to TMP is due to a grain size of >10 microns and/or low eutectic content. The excessive Al content of 9% in AZ91D led to severe edge cracking and 0% elongation in the TTMP condition of Table I. It is noted that AZ31 does not lend itself to fine grain injection molding and is therefore only presented in the table in Twin Roll Cast and Direct Cast/Extruded form.

TABLE I

Effect of Process on Grain Size

| Alloy | Process | Red, % | YS, MPa | UTS, MPa | El, % | Edge Cracking | Grain Size, μm |
|---|---|---|---|---|---|---|---|
| AZ31 | Commercial Twin Roll Cast/TMP | 44 | 187 | 291 | 10 | Severe | 45-85 |
| AZ31 | Commercial Twin Roll Cast/TMP | 73 | 199 | 281 | 9 | Severe | 45-85 |
| AZ31 | Commercial Direct Cast/Extruded/TMP | 50 | 215 | 280 | 17 | Moderate | 10 |
| AZ6/1.5 | Thixomolded/TMP | 47 | 232 | 351 | 9 | None | 1-2 |
| AZ6/1.5 | Thixomolded/TMP | 76 | 303 | 365 | 10 | None | 1-2 |
| AZ61L | Thixomolded/TMP | 50 | 319 | 377 | 9 | Minor | 1-2 |
| AZ91D | Thixomolded/TMP | 41 | 256 | 295 | 0 | Severe | 1-2 |

Table II (below) compares the benefits of TMP processing on the yield strength and elongation of injection molded (IM) sheet bars 30*b* of various AZ and ZA metal alloys. The metal alloys compared are AZ6/1.5 (Mg-6Al-1.5Zn), AZ62 (Mg-6Al-2Zn), AZ63 (Mg-6Al-2Zn), ZA55 (Mg-5Zn-5Al), ZA64 (Mg-6Zn-4Al), ZA75 (Mg-7Zn-5Al). As indicated by the results in the table, TMP processing of injection molded fine grain AZ and ZA metal alloy sheet bars 30 enhanced the mechanical properties with respect to both the alloy's strength and elongation. It is noted that the samples of the table were not subjected to either of the first or second heat treatments discussed elsewhere herein.

TABLE II

Benefit of TMP on Injection Molded Sheet Bars

| Alloy | Injection Molded YS, MPa | Injection Molded only Elong, % | TMP Reduction, % | Injection Molded + TMP YS, MPa | Injection Molded + TMP Elong., % |
|---|---|---|---|---|---|
| AZ6/1.5 | 181 | 6 | 76 | 303 | 10 |
| AZ62 | 157 | 8 | 67 | 283 | 11 |
| AZ63 | 145 | 8 | 72 | 299 | 7 |
| ZA55 | 176 | 4 | 74 | 231 | 9 |
| ZA64 | 194 | 4 | 77 | 256 | 8 |
| ZA75 | 165 | 5 | 74 | 263 | 10 |

Table III (below) compares the effects of TMP and various subsequent heat treatment processes on the properties of fine grain injection molded (IM) (Thixomolded®) AM60 alloy (Mg-6Al-0.2Zn). While not intending to be bound by theory, as indicated by the results in the table, TMP processing alone improves the alloy's yield strength, which is attributed to the refining of the grain size and the dividing and/or dissolving of the eutectic phase and then precipitating the β eutectic phase. Additional thermal treatments of 3 minutes at 250° C. or 15 minutes at 260° C. improved the combination of the alloy's yield strength and elongation. Notably however, thermal treatment at higher temperatures improved the elongation of the alloy at the expense of yield strength which is believed to result from grain growth during thermal treatment at the higher temperature. The higher temperature treatments also lowered the YS/UTS ratios, which would increase work hardening rate and increase formability.

TABLE III

TMP and Thermal Treatment Effect of Processing on Properties of Injection Molded (IM) AM60 Alloy

| Condition | YS, MPa | UTS, MPa | Elong., % | YS/UTS |
|---|---|---|---|---|
| As Injection Molded | 135 | 240 | 10 | .56 |
| Injection Molded + TMP | 316-320 | 368-370 | 9-11 | .86 |
| Injection Molded + TMP + 3 min./250° C. | 320 | 370 | 11 | .86 |
| Injection Molded + TMP + 3 min./300° C. | 240 | 315 | 16 | .76 |
| Injection Molded + TMP + 15 min./260° C. | 315 | 350 | 12 | .90 |
| Injection Molded + TMP + 15 min./275° C. | 230 | 310 | 14 | .74 |

Table IV (below) compares the effects of various thermal treatments on Injection Molded (IM) (Thixomolded®) and TMP processed AM60 metal alloy. As indicated by the results in the table, thermal processing of 3 minutes at 250° C. improved both the strength and elongation of the Thixomolded® and TMP processed AM60 metal alloy. Thermal treatments at 300° C. approximately doubled the elongation and lowered the YS/UTS ratio, while retaining yield strength of 244 MPa.

TABLE IV

TMP and Effect of Thermal Treatment on Properties of Injection Molded (IM) AM60

| Processing | YS, MPa | UTS, MPa | Elong., % | YS/UTS |
|---|---|---|---|---|
| As IM + TMP | 316 | 368 | 9 | .86 |
| +3 min/200° C. | 311 | 360 | 10 | .86 |
| +3 min/250° C. | 328 | 371 | 10 | .88 |
| +3 min/300° C. | 244 | 312 | 21 | .78 |
| +10 min/200° C. | 322 | 375 | 9 | .86 |
| +10 min/250° C. | 323 | 364 | 9 | .89 |
| +10 min/300° C. | 225 | 302 | 18 | .76 |
| +20 min/200° C. | 312 | 362 | 8 | .86 |
| +20 min/250° C. | 319 | 358 | 10 | .89 |
| +20 min/300° C. | 218 | 304 | 20 | .72 |

Figure 3:
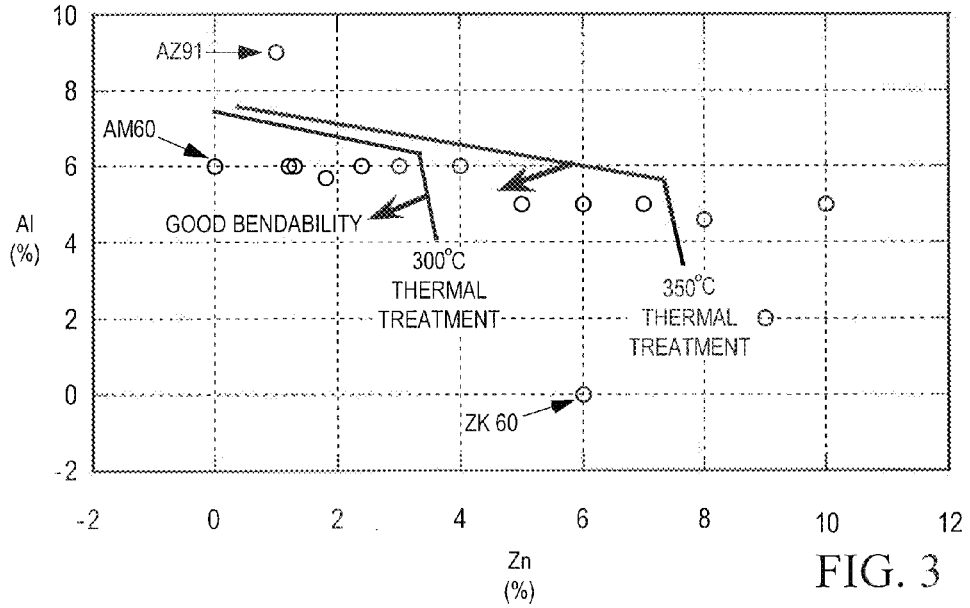
FIG. 3 is an Alloy Composition and Thermal Treatment Bendability chart showing various alloys and the effect of thermal treatments on their room temperature bendability (ductility and formability)

Referring to the chart of FIG. 3, a comparison is provided of various metal alloys that were TTMP processed and then subjected to a range of thermal treatments, and the effect on their room temperature bendability (ductility and formability). The metal alloys compared are commercially available AZ91, AM60 and ZK60, which are specifically identified in the figure by direct reference, and various other experimental metal alloy compositions. As indicated by the results, the thermal treatment of TTMP processed stock of Mg—Al—Zn metal alloys improves the room temperature formability. Notably, alloys with 6% Al or less had good bendability after annealing, if Zn was less than 8%. AZ91D with 9% Al was brittle, having 0 degree bendability, even after annealing.

Table V further compares the effects of the TTMP process and subsequent thermal treatments on properties AZ61L (Mg-6Al-1Zn) metal alloy. As indicated by the results in the table, TTMP processing alone increases the strength, presumably by refining grains and dividing and/or dissolving/solution the eutectic phase and then precipitating the β eutectic phase. Also, additional thermal treatments of the metal alloy at 3 minutes and 250° C. improve the strength and elongation.

Notably, higher temperatures and longer durations of thermal treatments to the metal alloy improve the elongation, but at the expense of strength which is believed to be due to grain growth of the alloy. Higher temperatures also lowered the YS/UTS ratio. After a higher temperature thermal treatment, a second thermal treatment at 170° C. returns some of the strength by additional precipitation of fine β eutectic phase.

TABLE V

Effect of TMP and Thermal Treatment on Properties of Injection Molded (IM) AZ61L Alloy

| Condition | YS, MPa | UTS, MPa | Elong., % | YS/UTS |
|---|---|---|---|---|
| As IM | 130 | 220 | 7 | .59 |
| IM + TMP | 305 | 360 | 6 | .85 |
| IM + TMP + 3 min./250° C. | 340 | 378 | 8 | .90 |
| IM + TMP + 3 min./300° C. | 227 | 310 | 16 | .73 |
| IM + TMP + 15 min./268° C. | 279 | 345 | 11 | .81 |
| IM + TMP + 15 min./275° C. | 226 | 310 | 14 | .73 |
| IM + TMP + 15 min./270° C. + 5 hr./170° C. | 288 | 350 | 10 | .82 |

Table VI compares the effects of thermal treatment on TTMP processed AZ61L metal alloy. As indicated by the results in the table, thermal processing of 3 minutes at 250° C. improves both the strength and elongation of the TTMP processed AZ61L metal alloy. Thermal treatments at 300° C. approximately doubled the elongation while lowering the strength and YS/UTS ratio which is believed to be due to grain growth.

TABLE VI

Effect of TMP Thermal Treatment on Injection Molded (IM) AZ61L

| Processing | YS, MPa | UTS, MPa | Elong., % | YS/UTS |
|---|---|---|---|---|
| as TTMP | 305 | 362 | 6 | .84 |
| +3 min/200° C. | 326 | 372 | 6 | .88 |

TABLE VI-continued

Effect of TMP Thermal Treatment on Injection Molded (IM) AZ61L

| Processing | YS, MPa | UTS, MPa | Elong., % | YS/UTS |
|---|---|---|---|---|
| +3 min/250° C. | 343 | 380 | 8 | .90 |
| +3 min/300° C. | 227 | 314 | 17 | .72 |
| +10 min/200° C. | 328 | 373 | 5 | .88 |
| +10 min/250° C. | 331 | 372 | 8 | .89 |
| +10 min/300° C. | 222 | 308 | 16 | .72 |
| +20 min/200° C. | 326 | 378 | 8 | .86 |
| +20 min/250° C. | 323 | 368 | 7 | .88 |
| +20 min/300° C. | 219 | 307 | 20 | .71 |

Table VII and FIG. 10 compare the effects of thermal treatment on TTMP processed AZ61L alloy. Some combinations of $1^{st}$ and $2^{nd}$ treatment provide the best combination of properties, e.g., for $1^{st}$ treatment alone—250° C. at 10-15 minutes; for double treatment—300° C.+130-170° C. As seen therein, the higher the first temperature and the longer the time, YS/UTS decreases.

TABLE VII

Effect of Thermal Treatment on AZ61L

| Processing & Heat Treat History | YS (MPa) | UTS (MPa) | Elong. (%) | YS/UTS |
|---|---|---|---|---|
| As TTMP | 305 | 362 | 6 | .84 |
| TTMP + 10 min250° C. | 284 | 348 | 13 | .82 |
| TTMP + 30 min250° C. | 250 | 326 | 16 | .80 |
| TTMP + 30 min275° C. | 231 | 313 | 17 | .74 |
| TTMP + 30 min300° C. | 215 | 311 | 20 | .69 |
| TTMP + 10 min250° C. + 3 hr170° C. | 258 | 330 | 16 | .78 |
| TTMP + 10 min250° C. + 6 hr170° C. | 254 | 325 | 19 | .78 |
| TTMP + 30 min250° C. + 3 hr210° C. | 244 | 317 | 16 | .77 |
| TTMP + 30 min250° C. + 6 hr210° C. | 264 | 328 | 11 | .80 |
| TTMP + 30 min275° C. + 3 hr170° C. | 234 | 316 | 17 | .74 |
| TTMP + 30 min275° C. + 6 hr170° C. | 231 | 309 | 14 | .75 |
| TTMP + 30 min275° C. + 3 hr210° C. | 230 | 311 | 15 | .74 |
| TTMP + 30 min275° C. + 6 hr210° C. | 231 | 313 | 12 | .74 |
| TTMP + 30 min300° C. + 3 hr130° C. | 231 | 330 | 20 | .70 |
| TTMP + 30 min300° C. + 7 hr130° C. | 226 | 331 | 20 | .68 |
| TTMP + 30 min300° C. + 16 hr130° C. | 229 | 337 | 19 | .68 |
| TTMP + 30 min300° C. + 1 hr170° C. | 229 | 338 | 18 | .68 |
| TTMP + 30 min300° C. + 3 hr170° C. | 220 | 330 | 23 | .67 |
| TTMP + 30 min300° C. + 7 hr170° C. | 220 | 323 | 22 | .68 |
| TTMP + 30 min300° C. + 16 hr170° C. | 230 | 326 | 15 | .70 |
| TTMP + 30 min300° C. + 1 hr210° C. | 227 | 325 | 23 | .70 |
| TTMP + 30 min300° C. + 3 hr210° C. | 231 | 323 | 21 | .72 |
| TTMP + 30 min300° C. + 7 hr210° C. | 222 | 315 | 17 | .70 |
| TTMP + 30 min300° C. + 16 hr210° C. | 216 | 308 | 23 | .70 |

In an alternative embodiment, a plurality of fine grain precursors or sheet bars 30 are formed by molded and rapidly solidified metal alloy using one of the molding techniques referred to and discussed in connection with FIG. 1. The sheet bars 30 are then provided in a stack, which may be formed of the same metal alloy, different metal alloys or one or more metal alloy and a reinforcement layer. The processing cell 10 refines the microstructure of the stack of sheet bars 30 by, for example, rolling of the stack of sheet bars 30 to form a layered wrought sheet form. Thereafter, the layered wrought sheet form is treated with one or more heat treatments.

The heat treated layered wrought sheet form may be actively or passively cooled. Preferably, gradual cooling (e.g. slow cooling) and/or step cooling is used, as opposed to rapid cooling or quenching, to allow the metal alloy of the layers to mechanically relax, partially reducing stresses which may result from any thermal shrinkage mismatch between the metal alloys and any reinforcements. For example, the metal alloy material, e.g., Mg alloy, may have a higher thermal expansion coefficient (e.g. coefficient of thermal expansion or CTE) than the reinforcement, e.g., ceramic material. Upon cooling, the Mg alloy will shrink more per degree temperature drop than the reinforcement. However, because Mg alloy has lower strength and higher elongation or yield at higher temperatures, which is generally true for most metal alloys, gradual cooling allows more of the shrinkage mismatch, between the ceramic reinforcement and the Mg alloy, to occur while the Mg alloy is at higher temperature and is more compliant. This reduces stress build-up within the layers that could otherwise cause delamination or cracking between the reinforcements and the metal alloy during or after superplastic press forming.

Alternatively, a layered structure may be formed by adhesively bonding the fine-grained sheets to polymer matrix composites that contain and which are reinforced by fibers such as carbon, Kevlar, polymer fibers and/or glass. For example, a prepreg composite laminate may be inserted between two or more wrought sheets 52 or alternatively, a wrought sheet 52 may have a prepreg composite laminate correspondingly positioned on each of two opposing outer surfaces of the wrought sheet 52 form. Examples of the prepreg composite are woven fibers, unidirectional fibers, bidirectional fibers or layered constructions thereof, where the fibers are impregnated with a B-staged resin, such as epoxy resin, bismaleimide (BMI) resin, polyimide (PI) resin, polyester resin, polyurethane (PU) resin or any other suitable resin known to those skilled in the art. The prepreg-wrought sheet structure is then exposed to one or more thermal treatments, such as for example, by convention, conduction (e.g. heated press), induction heating, infrared or alternatively, by hot isostatic processing (hipping). When hipping is employed, the hipping chamber generally applies a hipping process to the stack of between about 5,000 to 15,000 psi isostatic pressure and between about 250 to 350° C. temperature for about 0.5 to 2 hours. If desired, the thermally treated prepreg-wrought sheet structure may be further thermally treated. The thermal treatments cure the B-staged resin to bond the layers of the layered structure together and to form a load transfer means between the load carrying fiber reinforcements, enhancing the strength and mechanical properties of the layered structure.

Table VIII (below) compares the characteristics of TTMP processed fiber reinforced metal alloys that have been subsequently thermally treated. As indicated by the results in the table, the reinforced injection molded TMP samples had relatively better mechanical properties than conventionally processed reinforced metal alloys, including improved strength and modulus. AZ61L was TTMP and treated 15 minutes at 275° C., stack was bonded at 125° C. for 60 minutes.

TABLE VIII

Comparison of Reinforced Metal Alloys

| | TTMP + TT AZ61Mg/ Epoxy/Carbon Fiber | GLARE, 2024Al/Epoxy S Glass Fiber | Cortes AZ31Mg/Epoxy/ Glass Fiber | Cortes, AZ31Mg/Epoxy/ Carbon Fiber |
|---|---|---|---|---|
| E, GPa | 63 to 97 | 55 | 34 | 46 |
| Density, ρ (g/cc) | 1.70 | 2.38 | 1.88 | 1.68 |
| Bending Rigidity, $E^{1/3}/\rho$ | 2.34 to 2.70 | 1.60 | 1.72 | 2.13 |
| Dent Resistance, $YS^{1/2}/\rho$ | 16.8 to 17.7 | | | |
| Crash Resistance, $E^{1/5}/\rho$ | 1.35 to 1.47 | 0.94 | 1.07 | 1.28 |
| E/ρ | 37 to 57 | 23 | 18 | 27 |
| YS | 820 to 910 | 317 | — | — |
| YS/ρ | 482 to 535 | 133 | — | — |
| UTS | 820 to 910 | 580 | 440 | 420 |
| UTS/ρ | 482 to 535 | 244 | 234 | 250 |

The effects of shot velocity and fill time on blistering were also evaluated, specifically on AZ61L, and the resulting data is presented in Table VIIII. Blistering is a surface defect on the TTMP sheet (bubble-like protrusions) that destroy the utility of the product. Blisters derive from defects (high total porosity levels) in the molding of the fine grain precursor, which result in laminar defects in the TTMP sheet that blow up into bubbles during and after TMP.

TABLE VIIII

Effect of Shot Velocity on Blisters in TTMP AZ61L

| Shot Velocity, m/sec | Fraction of Sheets with Blister Defects |
|---|---|
| <2 | 0.3-0.4 |
| 2 | 0.2-0.3 |
| 2.25 | 0.1-0.2 |
| 2.5 | 0.0-0.1 |
| 2.75 | 0.0 |
| 3 | 0.0 |

Fine grained injection molded (Thixomolded®) samples were tested as a function of shot velocity and machine measured fill time, the results of which are presented in (Table IX). The strength and ductility were improved at higher shot velocities and shorter fill times.

TABLE IX

Effect of Shot Velocity and Machine Measured Fill Time on Properties of AZ61L*

| Shot Velocity, m/sec | Fill Time, sec | YS, MPa | UTS, MPa | Elong, % |
|---|---|---|---|---|
| 2.2 | .062 | 135-145 | 210-275 | 5-16 |
| 3.6 | .037 | 140-160 | 235-275 | 8-13 |

*Range of 6 samples

Furthermore, AZ61L was fine grained injection molded at a shot velocity of 3.9 msec with machine measured fill time of 0.037 seconds and an ideal fill time "t" of 0.023. After TTMP and a subsequent thermal treatment, there were no blisters and the YS was 256 MPa, UTS was 330 MPa, elongation was 20% and YS/UTS was 0.77. The ideal fill time t is defined by the following equation:

$$t = K\left(\frac{Ti - Tf + SZ}{Tf - Td}\right)T$$

where:

t=ideal filling time (cavity and overflows only—runner not included);

K=empirically derived constant (sec/in. or s/mm);

Ti=temperature of the molten metal as it enters the die;

Tf=minimum flow temperature of alloy (° F.);

Td=die cavity surface temperature just before contact with the metal (° F.);

S=percent solid fraction allowable in the material at the end of filling;

Z=units conversion factor, ° F./% (° C./%); and

T=casting thickness in inches.

As a person skilled in the art will readily appreciate, the above description is meant as an illustration of implementations of the principles of this invention. This description is not intended to limit the scope or application of this invention in that the invention is susceptible to modification, variation and change, without departing from spirit of this invention, as defined in the following claims.

The invention claimed is:

1. A method of forming a wrought material comprising the steps of:

providing a metal alloy material having a depressed solidus temperature and a low temperature eutectic phase transformation;

at least substantial melting the metal alloy material;

molding with high injection speed and short fill time and rapidly solidifying the metal alloy material to form a fine grain precursor having low porosity and fine grains surrounded by eutectic phase, the eutectic phase having fine dendritic arm spacing;

imparting plastic deformation to the fine grain precursor by a high strain rate deformation strain to reduce the porosity, to avoid blistering and to cause recrystallization without substantial shear banding, thereby forming a fine grain structure wrought form, the step of imparting plastic deformation further including:

at least one of subdividing or dissolving the eutectic phase; and precipitating a portion of the eutectic phase in situ;

imparting at least one thermal treatment to the fine grain structural wrought form to further disperse the eutectic phase and to define a thermally treated fine grain structure wrought form having grains finer than the fine grains and the fine dendritic arm spacing of the fine grain precursor form, the precipitated eutectic phase forming nanometer sized dispersoids within at least one of the fine grains and grain boundaries of the thermally treated fine grain structure wrought form.

2. The method according to claim 1 wherein the step of forming the fine grain precursor results in a porosity of less than about percent 1.5%.

3. The method according to claim 1 wherein the step of imparting at least one thermal treatment includes a first thermal treatment of exposing the fine grain structural wrought form to a temperature of between about 225° C. and 325° C.

4. The method according to claim 1 wherein the step of imparting at least one thermal treatment includes a first thermal treatment of exposing the fine grain structural wrought form to a temperature of between about 250° C. and 280° C. to enhance strength and ductility.

5. The method according to claim 1 wherein the step of imparting at least one thermal treatment includes a first thermal treatment of exposing the fine grain structural wrought form to a temperature of between about 275° C. and 300° C. whereby texture is minimized and formability enhanced.

6. The method according to claim 3 wherein the step of imparting at least one thermal treatment includes a second and subsequent thermal treatment of exposing the fine grain structural wrought form to a temperature of between about 125° C. and 215° C. after the first thermal treatment whereby the combination of strength and ductility is enhanced.

7. The method according to claim 4 wherein the step of imparting at least one thermal treatment includes a second and subsequent thermal treatment of exposing the fine grain structural wrought form to a temperature of between about 130° C. and 170° C. for 1-16 hours, whereby the combination of strength and ductility is enhanced.

8. The method according to claim 1, wherein during the step of imparting one or more thermal treatments the fine grain structural wrought form is subject to the step of imparting plastic deformation comprising one of flattening, stretching, deep drawing and superplastic forming.

9. The method according to claim 1 wherein the metal alloy material is a magnesium based alloy with alloying constituents comprising aluminum, zinc, manganese, calcium, strontium, samarium, cerium, rare earth metal, tin, zirconium, yttrium, lithium, antimony or a mixture thereof.

10. The method according to claim 1 wherein the metal alloy material is one of a Mg—Zn—Ca based alloys, a Mg—Zn—Y based alloys, and a Mg—Al—Zn based alloy containing Al in the range of between 4.5% and 8.5%.

11. The method according to claim 1 wherein the metal alloy material is an aluminum based alloy with alloying constituents comprising copper, magnesium, lithium, silicon, zinc, or a mixture thereof.

12. The method according to claim 1 wherein the metal alloy material is a copper based alloy with alloying constituents comprising magnesium, phosphorus, zinc, antimony, tin, silicon, titanium, or a mixture thereof.

13. The method according to claim 1 wherein the metal alloy material is a zinc based alloy with alloying constituents comprising aluminum, copper, or a mixture thereof.

14. The method according to claim 1 wherein the metal alloying material is a lead based alloy with alloying constituents comprising antimony, tin, or a mixture thereof.

15. The method according to claim 1 wherein the thermally treated fine grain structure wrought form has ultra fine grains.

16. The method according to claim 1 that defines a matrix phase including grain boundaries, and the eutectic phase pins the grain boundaries of the matrix phase.

17. The method according to claim 1 wherein the step of molding includes one of all-liquid metal injection molding of the metal alloy material and semi-solid metal injection molding of the metal alloy material.

18. The method according to claim 17 wherein the metal alloy material is injection molded at a shot velocity of more than about 3 m/sec.

19. The method according to claim 17 wherein the step of injection molding further includes applying a vacuum to the metal alloy material.

20. The method according to claim 17 wherein the step of injection molding further includes providing argon gas to the metal alloy material.

21. The method according to claim 17 wherein a machine measured fill time is less than 0.06 seconds and a calculated ideal fill time, t, is less than 0.04 seconds.

22. The method according to claim 1 wherein the step of molding includes die casting of the metal alloy material.

23. The method according to claim 1 wherein the step of molding includes continuous casting of the metal alloy material.

24. The method according to claim 1 wherein the step of imparting plastic deformation includes rolling the fine grain precursor.

25. The method according to claim 1 wherein the step of imparting plastic deformation includes extruding the fine grain precursor.

26. The method according to claim 1 wherein the step of imparting plastic deformation includes forging the fine grain precursor.

27. The method according to claim 1 wherein the step of imparting plastic deformation includes one of flow forming and spinning the fine grain precursor.

28. The method according to claim 1 wherein the step of imparting plastic deformation includes pressing the fine grain precursor.

29. The method according to claim 1 wherein the step of molding and rapidly solidifying includes cooling the metal alloy material in a mold at a cooling rate of more than about 50 degrees Celsius per second to form the fine grain precursor.

30. The method according to claim 1 wherein the high strain rate deformation strain ($\acute{\epsilon}$) produces a Zener factor (Z) of greater than about $10^9$ $s^{-1}$ as determined by the formula $Z=\{\acute{\epsilon}\times\exp(Q/RT)\}^{-0.2}$, where Q is the activation energy (135 kj $mol^{-1}$), T is the temperature, and R is the gas constant.

31. The method according to claim 1 wherein the fine grains of the fine grain precursor have sizes less than about 10 μm.

32. The method according to claim 1 wherein the eutectic phase of the fine grain precursor is between about 3% and 15% by volume of the metal alloy material.

33. The method according to claim 1 wherein the thermally treated fine grain structural wrought form has ultra fine grains with sizes of less than about 2 μm, and eutectic phase particulates with sizes of less than about 1 μm forming the nanometer sized dispersoids of the eutectic phase.

34. The method according to claim 1 further comprising the step wherein one of a plurality of the fine grain precursors and a plurality of the fine grain structural wrought forms are stacked to form a stack, and layers of the stack being bonded together by hot isostatic pressing the stack.

35. The method according to claim 34 where reinforcing elements are disposed between the layers of the stack and bonding of the layers includes bonding of reinforcing elements to the layers by hot isostatic pressing the stack.

36. The method according to claim 1 further comprising forming a laminate composite structure by bonding the fine grain structural wrought form to a polymer matrix composite that contains fibers comprising at least one of carbon fibers, polymer fibers, glass fibers and a mixture thereof.

37. A wrought material having a refined grain structure, the wrought material comprising:

a thermally treated fine grain structure wrought form formed of a metal alloy having a depressed solidus temperature and a low temperature eutectic phase transformation, the thermally treated fine grain structure wrought form having ultra fine grains and grain boundaries with nanometer sized dispersoids of precipitated eutectic phase within the ultra fine grains and/or the grain boundaries.

* * * * *